US009880519B2

(12) United States Patent
Miyoshi

(10) Patent No.: US 9,880,519 B2
(45) Date of Patent: Jan. 30, 2018

(54) TRANSFER APPARATUS, NON-TRANSITORY COMPUTER READABLE MEDIUM, AND IMAGE FORMING APPARATUS

(71) Applicant: FUJI XEROX CO., LTD., Tokyo (JP)

(72) Inventor: Ayaka Miyoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/233,024

(22) Filed: Aug. 10, 2016

(65) Prior Publication Data

US 2017/0277120 A1 Sep. 28, 2017

(30) Foreign Application Priority Data

Mar. 23, 2016 (JP) ..... 2016-058583

(51) Int. Cl.
*G03G 21/20* (2006.01)
*G03G 15/16* (2006.01)

(52) U.S. Cl.
CPC ..... *G03G 21/203* (2013.01); *G03G 15/1665* (2013.01)

(58) Field of Classification Search
CPC ..... G03G 21/203; G03G 15/1665
See application file for complete search history.

(56) References Cited

U.S. PATENT DOCUMENTS

2015/0117891 A1* 4/2015 Park ..... G03G 15/5004 399/88

FOREIGN PATENT DOCUMENTS

JP 2000187404 A * 7/2000
JP 2009-251057 A 10/2009

OTHER PUBLICATIONS

Machine Translation of JP 2000-187404 A, obtained on May 15, 2017.*

* cited by examiner

*Primary Examiner* — Gregory H Curran
(74) *Attorney, Agent, or Firm* — Sughrue Mion, PLLC

(57) ABSTRACT

A transfer apparatus includes a transfer unit, a detector, a supplying unit, and a controller. The transfer unit transfers a toner image onto an object onto which transfer is to be performed. The detector detects humidity. The supplying unit includes a constant voltage supplying unit that supplies a transfer voltage that is a constant voltage to the transfer unit, and a constant current supplying unit that supplies a transfer current that is a constant current to the transfer unit. The controller controls the supplying unit such that the transfer voltage is supplied from the constant voltage supplying unit to the transfer unit when transfer is performed in a case where the detected humidity is not greater than a threshold, and the transfer current is supplied from the constant current supplying unit to the transfer unit when transfer is performed in a case where the detected humidity exceeds the threshold.

5 Claims, 11 Drawing Sheets

FIG. 7

82T

| NO. | ATTRIBUTE INFORMATION | | CHARACTERISTIC INFORMATION |
|---|---|---|---|
| | PAPER-SHEET SIZE | PAPER-SHEET TYPE | PROCESS SPEED AND TRANSFER CURRENT |
| 1 | A4 | AP-1 | CI-1 |
| 2 | A4 | AP-2 | CI-2 |
| 3 | A3 | AP-3 | CI-3 |
| 4 | A3 | AP-4 | CI-4 |
| 5 | A5 | AP-5 | CI-5 |

FIG. 12A

| TRANSFER VOLTAGE [V] | TEMPERATURE-CONTROLLED PAPER SHEET | | HYDRATED PAPER SHEET | |
|---|---|---|---|---|
| | INCONSISTENCIES IN B COLOR | INCONSISTENCIES IN K COLOR | INCONSISTENCIES IN B COLOR | INCONSISTENCIES IN K COLOR |
| 1000 | ◎ | ○ | ○ | × |
| 900 | ○ | ○ | ○ | × |
| 800 | ○ | ◎ | ○ | × |
| 700 | × | ○ | ○ | × |
| 600 | × | ○ | ○ | ○ |
| 500 | × | ○ | ○ | ◎ |
| 400 | × | × | ○ | ○ |
| 300 | × | × | × | ○ |

FIG. 12B

| TRANSFER CURRENT [-μA] | TEMPERATURE-CONTROLLED PAPER SHEET | | HYDRATED PAPER SHEET | |
|---|---|---|---|---|
| | INCONSISTENCIES IN B COLOR | INCONSISTENCIES IN K COLOR | INCONSISTENCIES IN B COLOR | INCONSISTENCIES IN K COLOR |
| 150 | ○ | ○ | ◎ | × |
| 120 | ○ | ○ | ◎ | △ |
| 100 | ○ | ○ | ○ | △ |
| 80 | ○ | ○ | ○ | ○ |
| 70 | ◎ | ○ | ○ | ○ |
| 60 | ◎ | ○ | ○ | ◎ |
| 50 | ○ | ○ | ○ | ◎ |
| 40 | △ | ◎ | ○ | ◎ |

TRANSFER APPARATUS, NON-TRANSITORY COMPUTER READABLE MEDIUM, AND IMAGE FORMING APPARATUS

CROSS-REFERENCE TO RELATED APPLICATIONS

This application is based on and claims priority under 35 USC 119 from Japanese Patent Application No. 2016-058583 filed Mar. 23, 2016.

BACKGROUND

Technical Field

The present invention relates to a transfer apparatus, a non-transitory computer readable medium, and an image forming apparatus.

SUMMARY

According to an aspect of the invention, there is provided a transfer apparatus including a transfer unit, a detector, a supplying unit, and a controller. The transfer unit transfers a toner image onto an object onto which transfer is to be performed. The detector detects humidity. The supplying unit includes a constant voltage supplying unit that supplies a transfer voltage that is a constant voltage to the transfer unit, and a constant current supplying unit that supplies a transfer current that is a constant current to the transfer unit. The controller controls the supplying unit such that the transfer voltage is supplied from the constant voltage supplying unit to the transfer unit when transfer is performed in a case where the humidity detected by the detector is less than or equal to a threshold, and the transfer current is supplied from the constant current supplying unit to the transfer unit when transfer is performed in a case where the humidity detected by the detector exceeds the threshold.

BRIEF DESCRIPTION OF THE DRAWINGS

Exemplary embodiments of the present invention will be described in detail based on the following figures, wherein:

FIG. 7 is a conceptual image illustrating an example of a table illustrating a correspondence relationship between attribute information and characteristic information;

FIGS. 12A and 12B are conceptual images illustrating evaluation results of inconsistencies in density occurring in an image formed on the basis of a voltage and a current applied to the pair of rollers.

DETAILED DESCRIPTION

Figure 1:
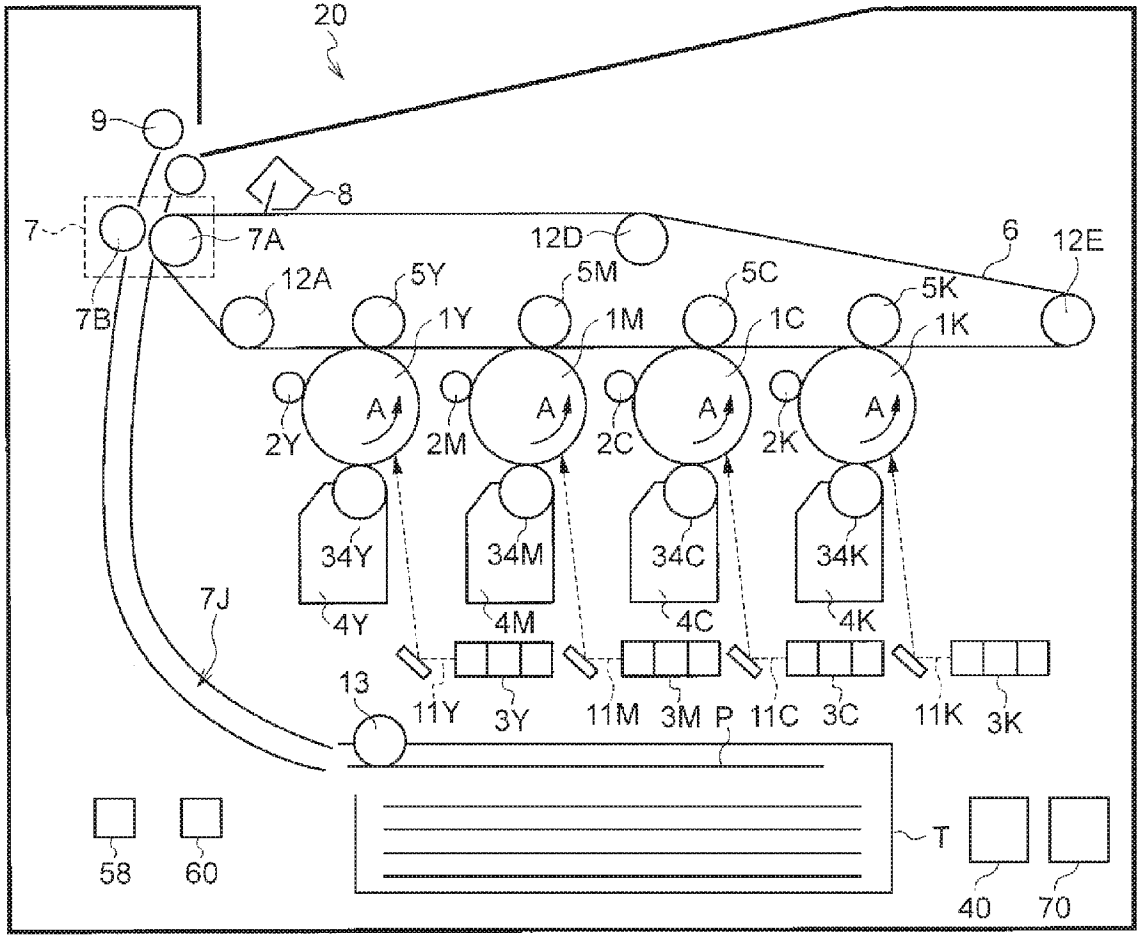
FIG. 1 is a schematic side view illustrating an example of the configuration of a main portion of an image forming apparatus.

In the following, an example of an image forming apparatus according to an exemplary embodiment of the present invention will be described in detail with reference to the drawings. Note that structural elements and processes operating and functioning in the same manner are denoted by the same reference numerals throughout all the drawings, and a redundant description may be omitted as necessary.

(First Exemplary Embodiment)

FIG. 1 is a schematic side view illustrating the configuration of a main portion of an image forming apparatus 20 according to the present exemplary embodiment and using an electrophotographic system. The image forming apparatus 20 is provided with an image forming function through which various types of data are received via communication lines, not illustrated, and a color-image forming process is performed on the basis of the received data.

Note that the case will be described in which the image forming apparatus 20 according to the present exemplary embodiment performs the color-image forming process using four colors: yellow, magenta, cyan, and black. However, the colors used in the color-image forming process are not limited to the four colors. For example, the colors used in the color-image forming process may also be three colors: yellow, magenta, and cyan, and may also be multiple colors obtained by adding, to the three colors that are yellow, magenta, and cyan, one or more colors that are different from the three colors.

In addition, regarding colors, yellow, magenta, cyan, and black are denoted by respective alphabets (color codes) that are Y, M, C, and K, and the following description will be made. In addition, when structural elements of the image forming apparatus 20 need to be distinguished from each other for the colors that are yellow, magenta, cyan, and black, the description will be made in which the alphabets (color codes) that are Y, M, C, and K are added after certain numbers. In the case where the structural elements do not need to be distinguished from each other for the colors, the alphabets (color codes) that are Y, M, C, and K are omitted after the certain numbers.

The image forming apparatus 20 includes photoconductor drums 1, chargers 2, laser output units 3, developing devices 4, and first transfer devices 5. For each of the colors Y, M, C, and K, a corresponding one of the photoconductor drums 1, a corresponding one of the chargers 2, a corresponding one of the laser output units 3, a corresponding one of developing rollers 34, a corresponding one of the developing devices 4, and a corresponding one of the first transfer devices 5 are provided.

The photoconductor drums 1 include photoconductor drums 1Y, 1M, 1C, and 1K that rotate in the direction indicated by an arrow A in FIG. 1, and the chargers 2 include chargers 2Y, 2M, 2C, and 2K each of which charges the surface of a corresponding one of the photoconductor drums 1 by applying a charging bias. The laser output units 3 include laser output units 3Y, 3M, 3C, and 3K each of which exposes, to light modulated in accordance with image information for a corresponding one of the colors, the charged surface of a corresponding one of the photoconductor drums 1 and forms an electrostatic latent image on the photoconductor drum 1. The developing devices 4 are provided with the developing rollers 34, which are developer carriers for carrying developers (toner) of respective colors. The developing devices 4 include developing devices 4Y, 4M, 4C, and 4K, and form toner images on the photoconductor drums 1 by applying a developing bias to developing rollers 34Y, 34M, 34C, and 34K using a developing-bias power source, not illustrated, and by developing the electrostatic latent images on the photoconductor drums 1 using toner of the colors. The first transfer devices 5 include first transfer devices 5Y, 5M, 5C, and 5K that transfer the toner images of the colors on the photoconductor drums 1 onto an intermediate transfer belt 6.

In addition, the image forming apparatus 20 includes a paper sheet storage unit T in which paper sheets P are stored, a secondary transfer apparatus 7 that transfers, onto a paper sheet P, a toner image formed on the intermediate transfer belt 6, a fuser 9 that fixes the toner image transferred to the paper sheet P, and a belt cleaner 8 that cleans toner left on the surface of the intermediate transfer belt 6 after transfer of the toner image onto the paper sheet P. In addition, the image forming apparatus 20 includes cleaners, not illustrated, that clean the surfaces of the photoconductor drums 1, and static removers, not illustrated, that remove the residual charge of the surfaces of the photoconductor drums 1.

Furthermore, the image forming apparatus 20 includes a thermometer 58 that measures a temperature in an image forming operation environment, and a hygrometer 60 that measures humidity in the image forming operation environment.

Furthermore, the image forming apparatus 20 includes, as a controller, an image forming controller 40 that performs control regarding image forming, and a transfer controller 70 that performs control regarding transfer among the control regarding image forming.

Next, an image forming operation in the image forming apparatus 20 illustrated in FIG. 1 will be described.

First, original image information with which an image is to be formed is output to the image forming apparatus 20 from a terminal apparatus such as a personal computer, not illustrated, via communication lines, not illustrated. When the original image information is input to the image forming apparatus 20, the image forming apparatus 20 applies a charging bias to the chargers 2, and negatively charges the surface of each photoconductor drum 1.

The original image information is input to the image forming controller 40. After converting the original image information into pieces of image data for respective colors Y, M, C, and K, the image forming controller 40 outputs, to the laser output units 3 for the corresponding colors, modulation signals based on the pieces of image data for the colors. Each laser output unit 3 outputs a laser beam 11 modulated in accordance with the input modulation signal input thereto.

The modulated laser beams 11 are emitted to the surfaces of the photoconductor drums 1. The surfaces of the photoconductor drums 1 are in the state of being negatively charged by the chargers 2. When the laser beams 11 are emitted to the surfaces of the photoconductor drums 1, the electric charge of portions to which the laser beams 11 are emitted disappear, and electrostatic latent images corresponding to the image data (the colors Y, M, C, and K) included in the original image information are formed on the photoconductor drums 1.

In addition, each of the developing devices 4Y, 4M, 4C, and 4K for the respective colors includes negatively charged toner and a developing roller 34. The toner in the developing device 4Y, the toner in the developing device 4M, the toner in the developing device 4C, and the toner in the developing device 4K are colored in Y, M, C, and K, respectively. The developing roller 34 adheres the corresponding toner to the surface of the corresponding photoconductor drum 1.

When the electrostatic latent images formed on the photoconductor drums 1 reach the developing devices 4, the developing-bias power source, not illustrated, applies the developing bias to the developing rollers 34 in the developing devices 4. Thereafter, the toner of the colors carried by the peripheries of the developing rollers 34Y, 34M, 34C, and 34K is adhered to the electrostatic latent images on the respective photoconductor drums 1Y, 1M, 1C, and 1K, and toner images corresponding to the image data for the colors in the original image information are formed on the photoconductor drums 1Y, 1M, 1C, and 1K.

Furthermore, a motor, not illustrated, rotates rollers 12A, 12D, and 12E, and a backup roller 7A of the secondary transfer apparatus 7, and the intermediate transfer belt 6 is pressed against the photoconductor drums 1 by being transported into gaps formed by the first transfer devices 5 and the photoconductor drums 1. Here, when a first transfer bias is applied by the first transfer devices 5, toner images formed on the photoconductor drums 1 and based on the image data for the colors are transferred onto the intermediate transfer belt 6. Thus, by controlling rotation of the rollers 12A, 7A, 12D, and 12E such that transfer start positions of the toner images of the colors match on the intermediate transfer belt 6, the toner images of the colors overlap with each other, and a toner image corresponding to the original image information is formed on the intermediate transfer belt 6.

Extraneous matter such as residual toner adhered to the surfaces of the photoconductor drums 1 from which the toner images have been transferred onto the intermediate transfer belt 6 is removed by the cleaners, not illustrated, and residual electric charge is removed by the static removers, not illustrated.

The secondary transfer apparatus 7 includes the backup roller 7A and a secondary transfer roller 7B that extend the intermediate transfer belt 6. The secondary transfer roller 7B is in contact with the intermediate transfer belt 6, and rotates following transportation of the intermediate transfer belt 6.

In addition, a paper sheet P in the paper sheet storage unit T is transported into the gap between the backup roller 7A and the secondary transfer roller 7B (hereinafter referred to as a pair of rollers) of the secondary transfer apparatus 7 through a transport path 7J including transportation rollers, not illustrated, by the motor, not illustrated, rotating a paper sheet transportation roller 13.

When the paper sheet P is pressed against the intermediate transfer belt 6 by the pair of rollers in a state in which the paper sheet P faces the surface of the intermediate transfer belt 6 on which the toner image is formed, a secondary transfer bias is applied to the pair of rollers, and the toner image formed on the intermediate transfer belt 6 and corresponding to the original image information is transferred onto the paper sheet P. The toner image transferred onto the paper sheet P is heated and melted by the fuser 9, and then fixed on the paper sheet P.

In addition, extraneous matter such as residual toner adhered to the surface of the intermediate transfer belt 6 from which the toner image has been transferred onto the paper sheet P is removed by the belt cleaner 8.

As described above, the image corresponding to the original image information is formed on the paper sheet P, and the image forming operation ends.

Figure 2:
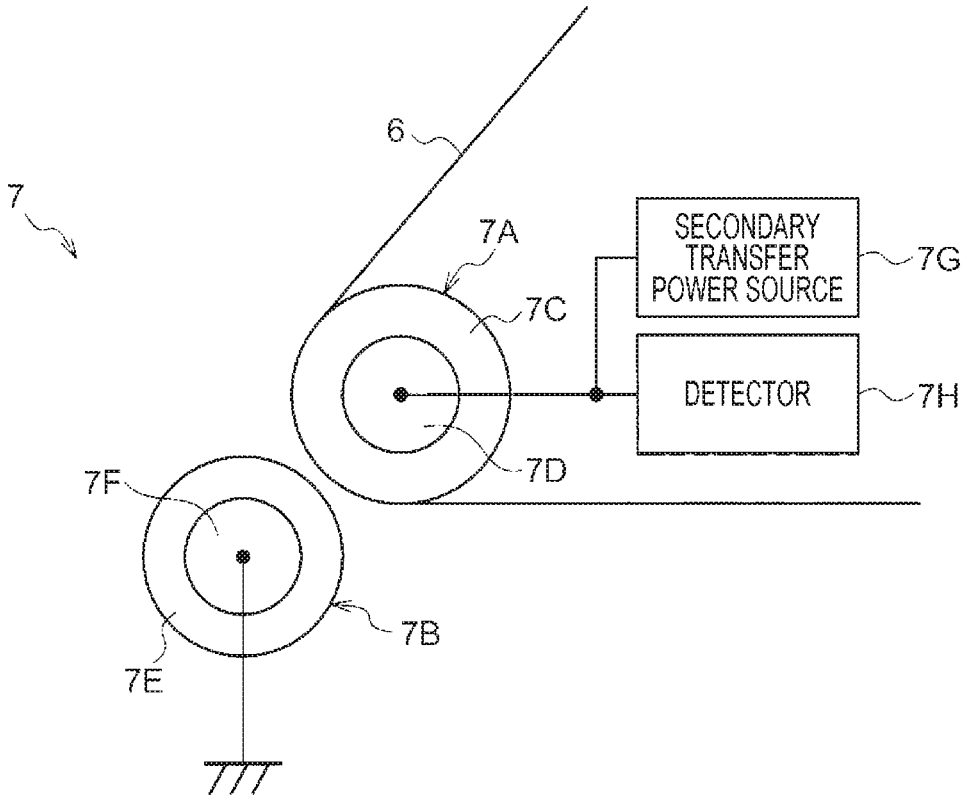
FIG. 2 is a schematic diagram used to describe the configuration of a main portion of a transfer apparatus.

FIG. 2 illustrates an example of the configuration of the secondary transfer apparatus 7 of the image forming apparatus 20 according to the present exemplary embodiment. A transfer operation performed for transfer to a paper sheet P by the secondary transfer apparatus 7 illustrated in FIG. 2 and performed in the case where an image is to be formed on the paper sheet P will be described.

The secondary transfer apparatus 7 includes the backup roller 7A, the secondary transfer roller 7B, a secondary transfer power source 7G, and a detector 7H. The backup roller 7A extends and transports the intermediate transfer belt 6 together with the rollers 12A, 12D, and 12E using the motor, not illustrated. The secondary transfer roller 7B is provided at a position at which the secondary transfer roller 7B faces the backup roller 7A with the intermediate transfer belt 6 therebetween. The secondary transfer power source 7G supplies power (a voltage and a current) to the pair of rollers. The detector 7H detects power (a voltage and a current) flowing through the pair of rollers. The detector 7H includes an ammeter that detects a current flowing through the pair of rollers when a voltage is applied to the pair of rollers by the secondary transfer power source 7G, and a voltmeter that detects a voltage across the pair of rollers when a current is applied to the pair of rollers by the secondary transfer power source 7G.

The secondary transfer power source 7G includes a constant voltage output unit 72 and a constant current output unit 74 as described in the following, and uses a direct-current power source capable of switching between constant voltage output and constant current output in accordance with a command from the transfer controller 70 (see FIG. 4). In addition, the voltage or current applied to the pair of rollers by the secondary transfer power source 7G is made adjustable by the transfer controller 70, which will be described later. A positive electrode of the secondary transfer power source 7G is connected to the ground potential (for example, 0V), which is a reference potential (not illustrated), and a negative electrode is connected to a metal shaft 7D of the backup roller 7A. The detector 7H is also connected to the metal shaft 7D of the backup roller 7A.

The backup roller 7A is, as an example, a rotatable roller having a diameter of 18 mm obtained by forming solid rubber 7C around the metal shaft 7D having a diameter of 14 mm. For the solid rubber 7C, a conductive material is used whose resistance value is adjusted to be greater than or equal to $1\times10^{6}\Omega$ but not greater than $1\times10^{7}\Omega$ by adding an ion conductive material to acrylonitrile-butadiene rubber (NBR), which has high oil resistance, high wear resistance, and high aging resistance.

Note that as an example of the solid rubber 7C, a conductive material obtained by blending NBR and epichlorohydrin rubber (ECO) may also be used. In addition, as another example, a conductive material based on polyurethane rubber obtained by adding an ion conductive material to rubber obtained by causing a polyether polyol to react with an isocyanate may also be used. Furthermore, as another example, a conductive material based on ethylene-propylene-diene rubber (EPDM) may be used.

In contrast, the secondary transfer roller 7B is, as an example, a rotatable roller having a diameter of 18 mm obtained by forming formed rubber 7E around a metal shaft 7F having a diameter of 12 mm. For the formed rubber 7E, a material is used whose resistance value is adjusted to be greater than or equal to $1\times10^{7}\Omega$ but not greater than $1\times10^{8}\Omega$ by adding an ion conductive material to urethane, which has high cushioning. Note that the metal shaft 7F is connected to the ground potential.

The transfer controller 70 (which will be described in detail later) of the secondary transfer apparatus 7 applies a negative voltage from the secondary transfer power source 7G to the pair of rollers at a timing at which a paper sheet P is transported into the gap formed by the pair of rollers.

In addition to a push pressure with which the pair of rollers pushes the paper sheet P and the intermediate transfer belt 6 while rotating, the power to strip off a negatively charged toner image from the intermediate transfer belt 6 is then generated by a negative electric field generated in the gap between the pair of rollers, and the toner image formed on the intermediate transfer belt 6 is transferred onto the paper sheet P.

Figure 3:
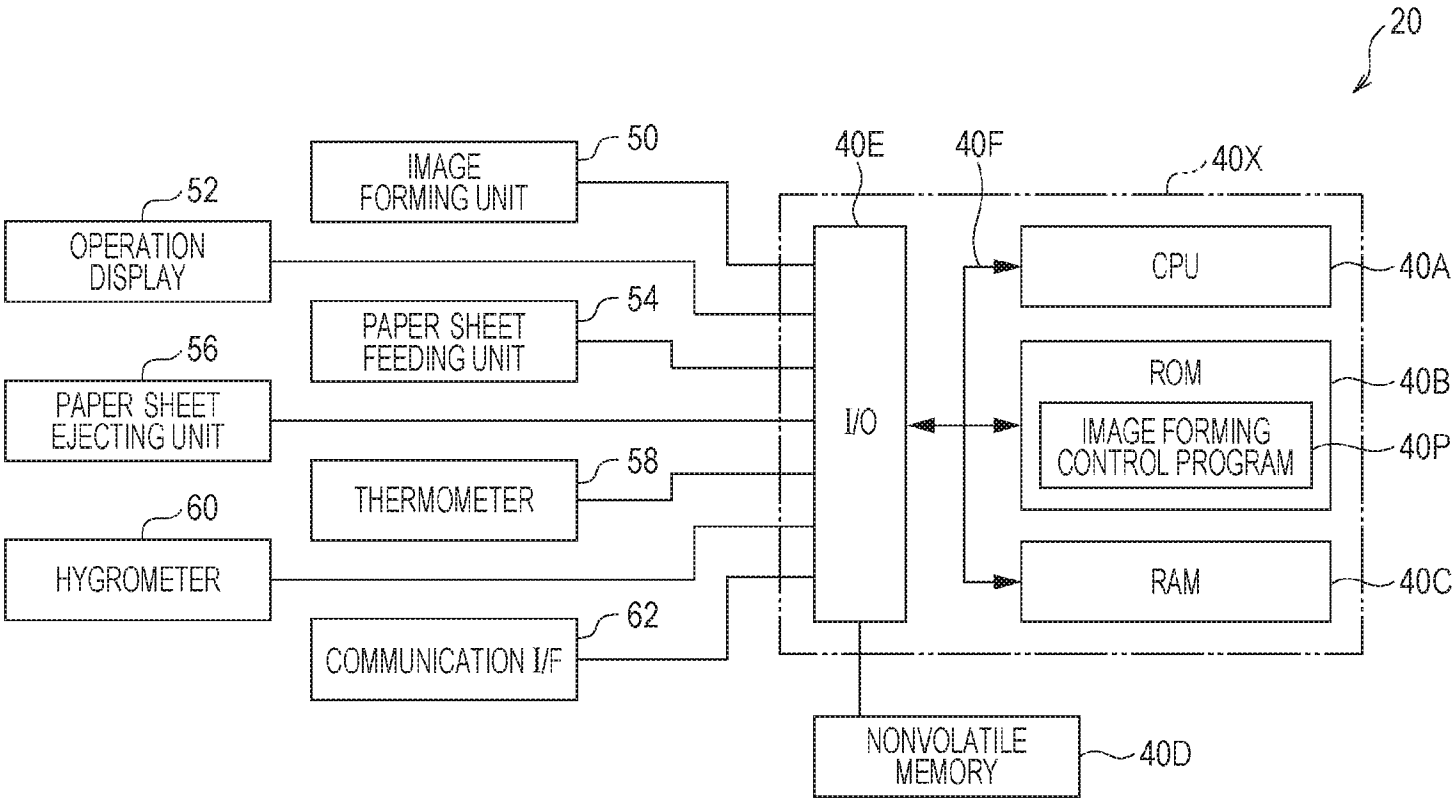
FIG. 3 is a block diagram illustrating an example of the configuration of a main portion of an electrical system of the image forming apparatus.

FIG. 3 illustrates an example of the configuration of the image forming controller 40 that performs the image forming operation in the image forming apparatus 20. FIG. 3 illustrates an example of a computer 40X, which is the image forming controller 40 when configured as a computer. The computer 40X is configured such that a central processing unit (CPU) 40A, a read-only memory (ROM) 40B, a random-access memory (RAM) 40C, a nonvolatile memory 40D, and an input-output interface (I/O) 40E are connected to each other via a bus 40F. An image forming unit 50, an operation display 52, a paper sheet feeding unit 54, a paper sheet ejecting unit 56, the thermometer 58, the hygrometer 60, and a communication I/F 62 are connected to the I/O 40E.

An image forming control program 40P that the computer 40X is caused to execute is stored in the ROM 40B. The CPU 40A reads out the image forming control program 40P from the ROM 40B, loads the image forming control program 40P into the RAM 40C, and executes a process based on the image forming control program 40P. The CPU 40A executes the process based on the image forming control program 40P, so that the computer 40X operates as the image forming controller 40. Note that the image forming control program 40P may also be provided through a recording medium such as a CD-ROM.

The image forming unit 50 includes devices necessary for the image forming apparatus 20 to execute the image forming operation. Example of the devices are the photoconductor drums 1, the chargers 2, the laser output units 3, the developing devices 4, the intermediate transfer belt 6, the secondary transfer apparatus 7, and the fuser 9.

The operation display 52 includes a touch panel display, not illustrated, hardware keys, not illustrated, and the like. A display button for realizing reception of an operation command and various types of information are displayed on the touch panel display. Examples of hardware keys are a numeric keypad and a start button.

The paper sheet feeding unit 54 includes, for example, the paper sheet storage unit T in which paper sheets P are stored, and a feeding mechanism that feeds paper sheets P from the paper sheet storage unit T to the image forming unit 50.

The paper sheet ejecting unit 56 includes, for example, an ejection unit to which paper sheets P are ejected, and an ejection mechanism for ejecting, onto the ejection unit, a paper sheet P on which an image is formed by the image forming unit 50.

The thermometer 58 measures a temperature in an image forming operation environment of the image forming apparatus 20. Note that the thermometer 58 may measure not only the internal temperature of the image forming apparatus 20 but also, for example, a temperature in a place where the image forming apparatus 20 is installed, for example the external temperature of the image forming apparatus 20.

The hygrometer 60 measures humidity in the image forming operation environment of the image forming apparatus 20. Note that, similarly to the thermometer 58, the hygrometer 60 may measure not only the internal humidity of the image forming apparatus 20 but also, for example, humidity in the place where the image forming apparatus 20 is installed, for example the external humidity of the image forming apparatus 20.

The communication I/F 62 is an interface for mutually performing data communication with a terminal apparatus such as a personal computer, not illustrated.

Figure 4:
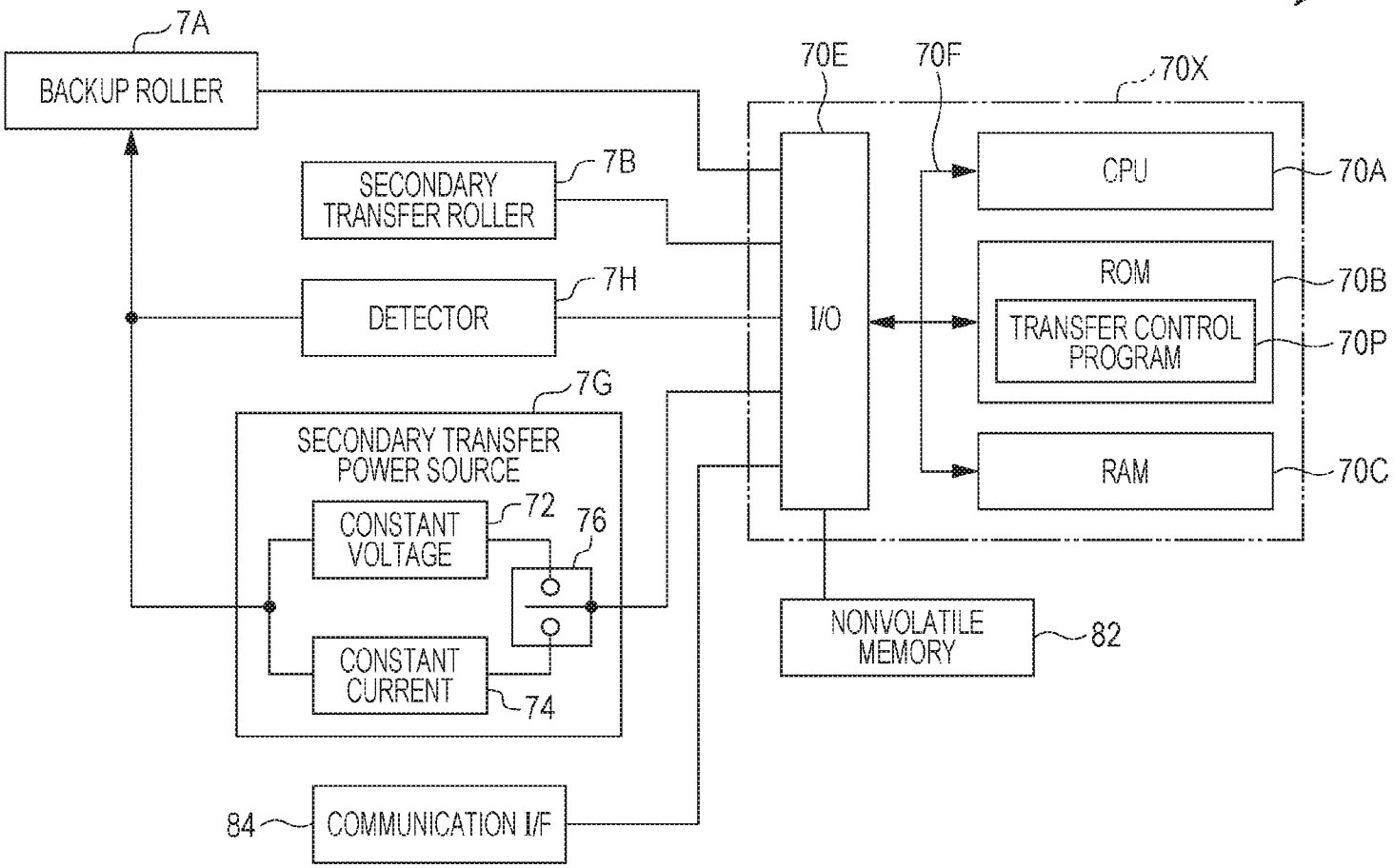
FIG. 4 is a block diagram illustrating an example of the configuration of a main portion of an electrical system of the transfer apparatus.

FIG. 4 illustrates an example of the configuration of the transfer controller 70 of the secondary transfer apparatus 7 according to the present exemplary embodiment. FIG. 4 illustrates an example of a computer 70X, which is the transfer controller 70 when configured as a computer. The computer 70X is configured such that a CPU 70A, a ROM 70B, a RAM 70C, and an I/O 70E are connected to each other via a bus 70F. The backup roller 7A, the secondary transfer roller 7B, the secondary transfer power source 7G, the detector 7H, a nonvolatile memory 82, and a communication I/F 84 are connected to the I/O 70E. Note that the CPU 70A may be connected to the image forming controller 40 (the I/O 40E of the computer 40X) of the image forming apparatus 20 via the communication I/F 84.

A transfer control program 70P that the computer 70X is caused to execute is stored in the ROM 70B. The CPU 70A reads out the transfer control program 70P from the ROM 70B, loads the transfer control program 70P into the RAM 70C, and executes a process based on the transfer control program 70P. The CPU 70A executes the process based on the transfer control program 70P, so that the computer 70X operates as the transfer controller 70. Note that the form of supplying the transfer control program 70P in a state in which the transfer control program 70P is stored on a computer readable recording medium such as a CD-ROM, the form of distributing the transfer control program 70P via a wired or wireless communication unit, and the like may also be applied.

The secondary transfer power source 7G includes the constant voltage output unit 72 that outputs a constant voltage and the constant current output unit 74 that outputs a constant current. In addition, the secondary transfer power source 7G includes a switching unit 76 to which the transfer controller 70 is connected. The switching unit 76 performs switching between power output from the constant voltage output unit 72 and power output from the constant current output unit 74 in accordance with a command from the transfer controller 70. In addition, the value of output power (a voltage or a current) from each of the constant voltage output unit 72 and the constant current output unit 74 is set by the transfer controller 70, and the power output from the secondary transfer power source 7G is adjustable.

The detector 7H measures power (a current or a voltage) at the pair of rollers when a predetermined power (a voltage or a current) is applied to the pair of rollers. That is, the detector 7H includes the ammeter that detects a current flowing through the pair of rollers when a voltage is applied to the pair of rollers by the secondary transfer power source 7G, and the voltmeter that detects a voltage across the pair of rollers when a current is applied to the pair of rollers by the secondary transfer power source 7G. The detector 7H detects a current flowing through the pair of rollers in the case where a predetermined voltage is supplied from the secondary transfer power source 7G. The detector 7H detects a voltage across the pair of rollers in the case where a predetermined current is supplied from the secondary transfer power source 7G.

The nonvolatile memory 82 stores various values of voltages and currents used in the secondary transfer apparatus 7 (details will be described later). Note that the nonvolatile memory 82 is not necessary for the secondary transfer apparatus 7, and for example the nonvolatile memory 40D included in the computer 40X of the image forming apparatus 20 may be substituted.

The voltage of the secondary transfer power source 7G that the secondary transfer apparatus 7 applies to the pair of rollers at the time of transfer (hereinafter referred to as transfer voltage) is set on the basis of the resistance value of the pair of rollers (hereinafter referred to as a system resistance value).

However, the system resistance value changes in accordance with the characteristics of the solid rubber 7C and those of the formed rubber 7E. For example, due to uneven addition of the ion conductive material or addition of foreign matter to the solid rubber 7C and the formed rubber 7E, the system resistance value changes every time a toner image is transferred onto a paper sheet P.

In an example of constant voltage control in the case where the system resistance value is calculated, a predetermined voltage (hereinafter referred to as transfer-voltage setting voltage), which is a constant voltage, is applied from the secondary transfer power source 7G in a period in which a toner image formed on the intermediate transfer belt 6 is not transferred onto a paper sheet P (hereinafter referred to as non-transfer period). The current flowing through the pair of rollers (hereinafter referred to as detection current) is then detected by the detector 7H, the system resistance value is calculated, before transfer, from the relationship between the transfer-voltage setting voltage and the detection current, and the transfer voltage is set.

However, the system resistance value changes in accordance with an apparatus environment. For example, in the solid rubber 7C and the formed rubber 7E each of which uses a certain conductive material to which a certain ion conductive material is added, the system resistance value changes depending on an environment state based on a temperature and humidity at the time of transfer.

Figure 5:
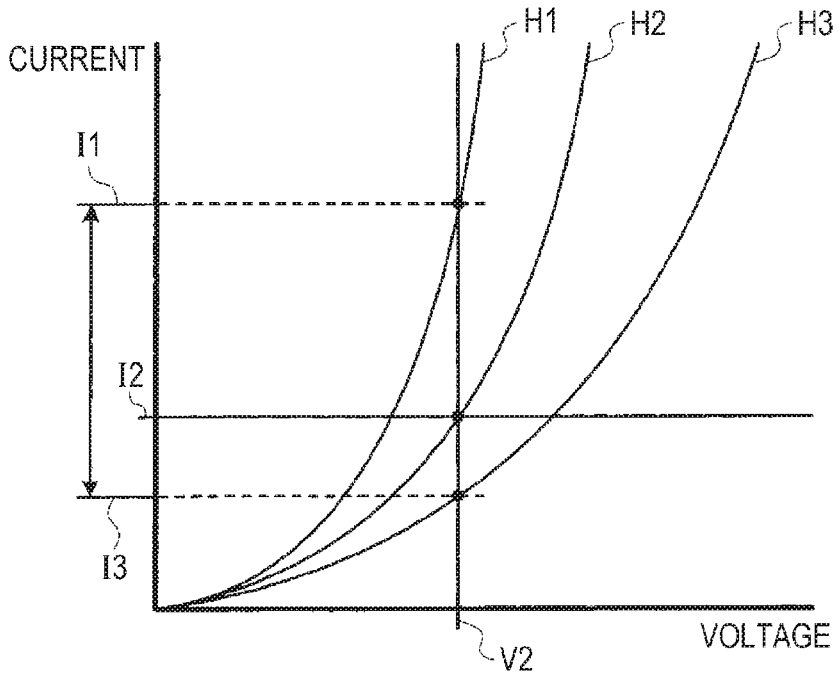
FIG. 5 is a conceptual image illustrating an example of voltage-current characteristics of a conductive material.

FIG. 5 illustrates voltage-current characteristics regarding, for example, a certain conductive material to which a certain ion conductive material is added (for example, the solid rubber 7C). Curves H1, H2, and H3 illustrate voltage-current characteristics in respective humidity environment states in which humidity differs from each other. The conductive material has a voltage dependence, and also a humidity-environment-state dependence. As illustrated in FIG. 5, the current value appropriate for a voltage value V2 is a value I2 in the voltage-current characteristics obtained in the humidity environment state indicated by the curve H2. Thus, a voltage having a voltage value of V2 is applied as a transfer-voltage setting voltage, a detection current is detected, and a system resistance value is calculated. However, in different humidity environment states, that is, in the voltage-current characteristics indicated by the curve H1, the voltage value V2 corresponds to a current value I1, and in the voltage-current characteristics indicated by the curve H3, the voltage value V2 corresponds to a current value I3. Variations arise in current value, and image quality may be deteriorated at the time of transfer.

Thus, according to the present exemplary embodiment, constant voltage control is performed on the pair of rollers by applying a constant voltage in normal times. When an environment state based on a temperature and humidity exceeds a predetermined change range, switching is performed from the constant voltage control to constant current control.

A current flowing when a toner image is transferred changes in accordance with attribute information regarding paper sheets P. In addition, the current flowing when a toner image is transferred changes in accordance with an image forming speed (hereinafter referred to as process speed) determined on the basis of the speed of transporting a paper sheet P, the speed of transporting the intermediate transfer belt 6, or the like.

Figure 6:
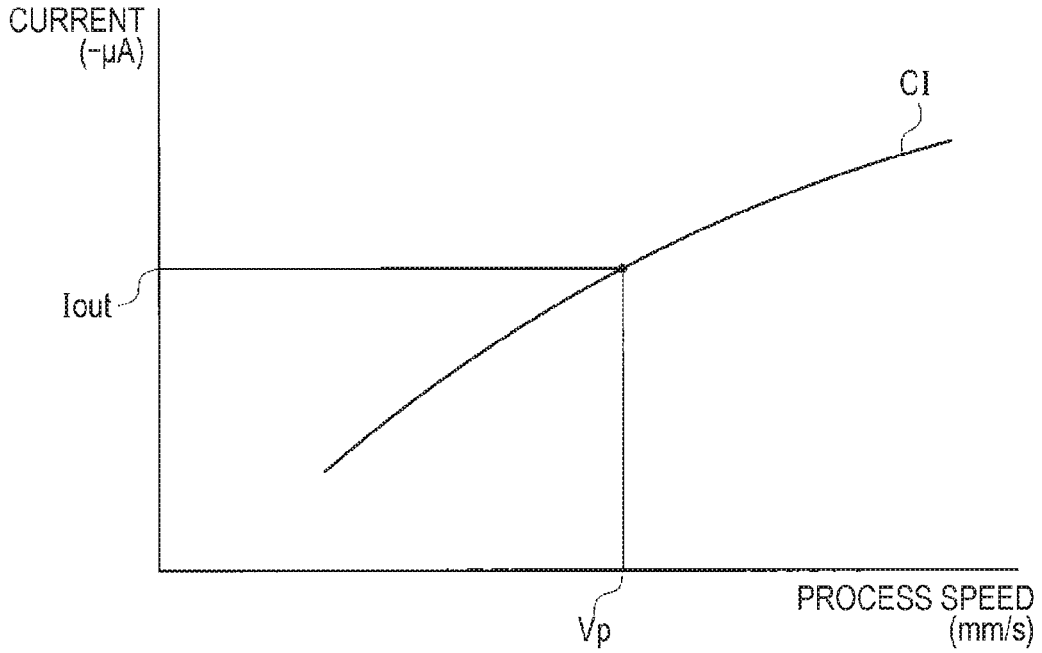
FIG. 6 is a conceptual image illustrating an example of characteristics regarding a process speed and a current.

FIG. 6 illustrates an example of characteristics regarding a process speed and a current supplied by the secondary transfer apparatus 7. As illustrated in FIG. 6, as the process speed increases, the current value of the current supplied by the secondary transfer apparatus 7 increases.

Thus, according to the present exemplary embodiment, when switching to constant current control is performed for the transfer operation, a current value corresponding to the attribute information regarding paper sheets P is used as the current value of the current supplied when a toner image is transferred onto a paper sheet P among the paper sheets P. In addition, the current value corresponding to the attribute information regarding the paper sheets P changes in accordance with the process speed, and thus as the current value corresponding to the attribute information regarding the paper sheets P, a current value determined from the characteristics regarding the process speed and the current is used.

Thus, the nonvolatile memory 82 stores at least information indicating a current value predetermined in accordance with the attribute information regarding the paper sheets P as information indicating a current value to be used at the secondary transfer apparatus 7. The attribute information includes, for example, type information (normal paper, embossed paper, coated paper, or the like) regarding paper sheets P to be used in image forming and specified by the operation display 52 of the image forming apparatus 20, and size information (A3, A4, or the like) regarding the paper sheets P. According to the present exemplary embodiment, the nonvolatile memory 82 stores at least a correspondence relationship between the attribute information regarding the paper sheets P and the current value of the current supplied by the secondary transfer apparatus 7 under constant current control when a toner image is transferred onto a paper sheet P having the attribute information. Information indicating a relationship between the attribute information regarding the paper sheet P and the current value corresponding to the attribute information regarding the paper sheet P is stored as a table 82T.

FIG. 7 illustrates an example of the table 82T. FIG. 7 illustrates the case where an example of the attribute information includes information indicating the sizes of paper sheet P such as A3, A4, and the like, and information (AP-1 to AP-5) indicating the types of paper sheet P indicating paper quality such as normal paper, coated paper, and the like. In addition, a current value corresponding to the attribute information regarding paper sheets P, that is, a current supplied when a toner image is transferred onto a paper sheet P changes in accordance with a process speed, and thus a current value determined from the characteristics regarding a process speed and a current is used. FIG. 7 illustrates the case where characteristic information indicating the characteristics regarding a process speed and a current is used as information indicating a current value corresponding to the attribute information regarding the paper sheet P.

Next, the transfer operation performed for a paper sheet P by the secondary transfer apparatus 7 of the image forming apparatus 20 according to the present exemplary embodiment when an image is formed on a paper sheet P will be described in detail.

Note that, for a transfer-voltage setting voltage Vo used in the following description, a current flowing through the pair of rollers in a standard environment state is obtained in advance through an experiment or the like, and is prestored in the nonvolatile memory 82. For the transfer-voltage setting voltage Vo stored in the nonvolatile memory 82, information corresponding to attribute information such as the paper sheet type of a paper sheet P onto which a toner image is to be transferred, size information regarding the paper sheet P, and transfer-surface information (information indicating whether a surface onto which transfer is to be performed (hereinafter simply referred to as transfer surface) is the front or rear surface of the paper sheet P) is stored. In addition, for a voltage-correction current Io, a current flowing through the pair of rollers in the standard environment state is obtained in advance through an experiment or the like, and is prestored so as to be associated with the attribute information in the nonvolatile memory 82.

Figure 8:
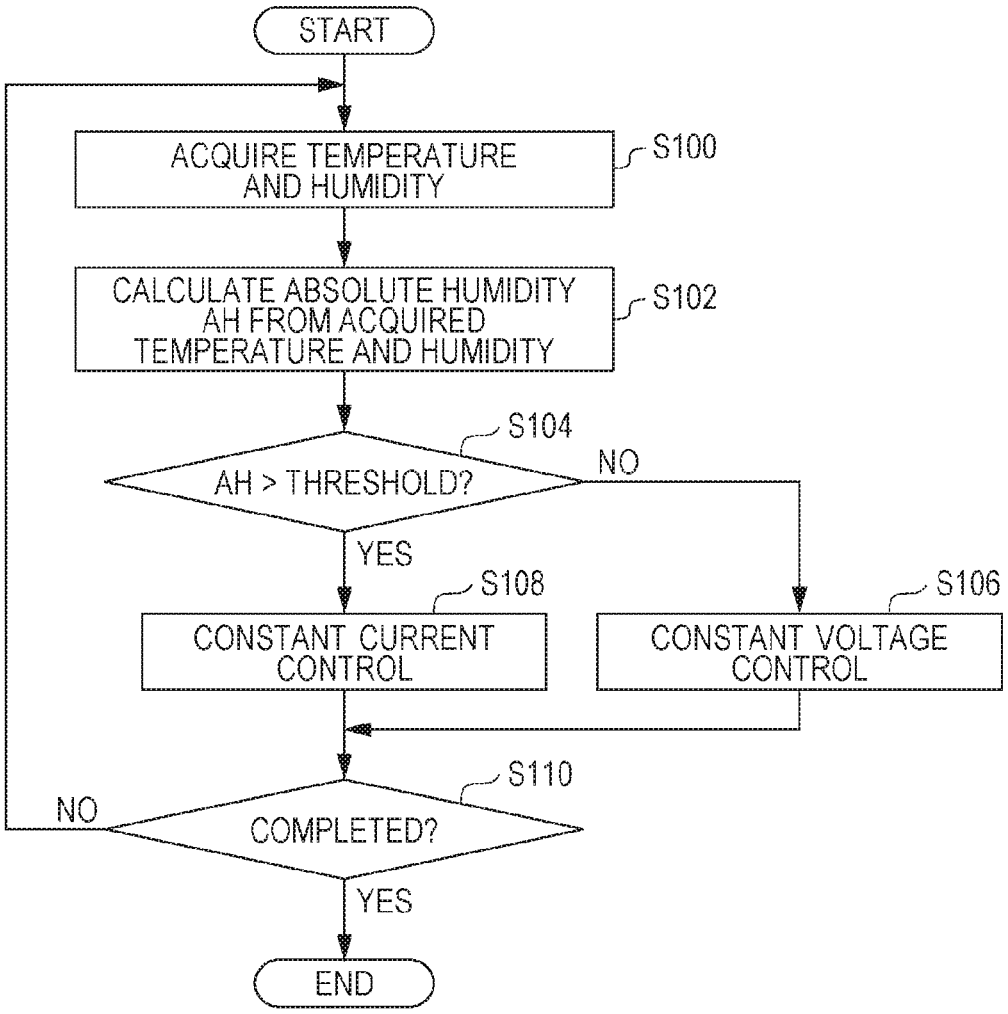
FIG. 8 is flowchart illustrating an example of a process executed by a computer of the transfer apparatus.

FIG. 8 illustrates a flowchart of the transfer control program 70P executed by the CPU 70A of the computer 70X, the CPU 70A operating as the transfer controller 70 of the secondary transfer apparatus 7 at the time of image forming.

The transfer control program 70P is executed by the CPU 70A when a transfer start command is received from the CPU 40A of the image forming apparatus 20 via the I/O 40E.

First, in step S100, when the transfer start command is received from the CPU 40A of the image forming apparatus 20, information indicating a temperature and humidity is acquired as an image forming operation environment of the image forming apparatus 20. The CPU 70A requests, at this point in time, information indicating the temperature measured by the thermometer 58 and information indicating the humidity measured by the hygrometer 60 from the image forming controller 40, and acquires the information indicating the temperature and the information indicating the humidity output from the image forming controller 40. Note that information indicating the transfer start command when the transfer start command is issued may also include information indicating a temperature and humidity at the time when the transfer start command is issued.

Note that the transfer start command includes specification of a process speed, and information indicating the specified process speed is also acquired in step S100. In addition to the information indicating the process speed, the transfer start command includes, for example, extra information associated with transfer such as transfer-surface information (information indicating whether a transfer surface is the front or rear surface of a paper sheet) as attribute information such as the paper sheet type (information such as normal paper, embossed paper, or coated paper) of a paper sheet P onto which a toner image is to be transferred, and size information (information such as A4 or A3) regarding the paper sheet P.

Next, in step S102, absolute humidity AH is calculated using the following Expression (1) using the information indicating the temperature and humidity acquired in step S100.

$$AH=(5.375-0.077\cdot TP+0.0027\cdot TP^2)\cdot RH/100 \quad (1)$$

where TP represents temperature and RH represents humidity. Note that the absolute humidity AH does not have to be calculated from Expression (1).

Next, in step S104, it is determined whether the absolute humidity AH has exceeded a certain humidity range. The certain humidity range indicates an environment change (humidity change) range in which image deterioration caused at the time of transfer is allowable, and may be obtained in advance through an experiment or the like. In the case where YES is obtained in step S104, the process proceeds to step S106 and constant voltage control is performed. In the case where NO is obtained in step S104, the process proceeds to step S108 and constant current control is performed. Thereafter, in step S110, it is determined whether a transfer process for transferring a toner image onto a paper sheet P is completed. In the case where YES is obtained in step S110, processing of the transfer control program 70P ends. In the case where NO is obtained in step S110, the process returns to step S100 and the transfer process is repeated.

That is, in the case where a transfer start command is received, and an environment state based on a temperature and humidity falls within an allowable range, transfer control is performed under constant voltage control using a transfer voltage. In the case where the environment state based on the temperature and humidity does not fall within the allowable range, constant current control is performed using a transfer current.

Figure 9:
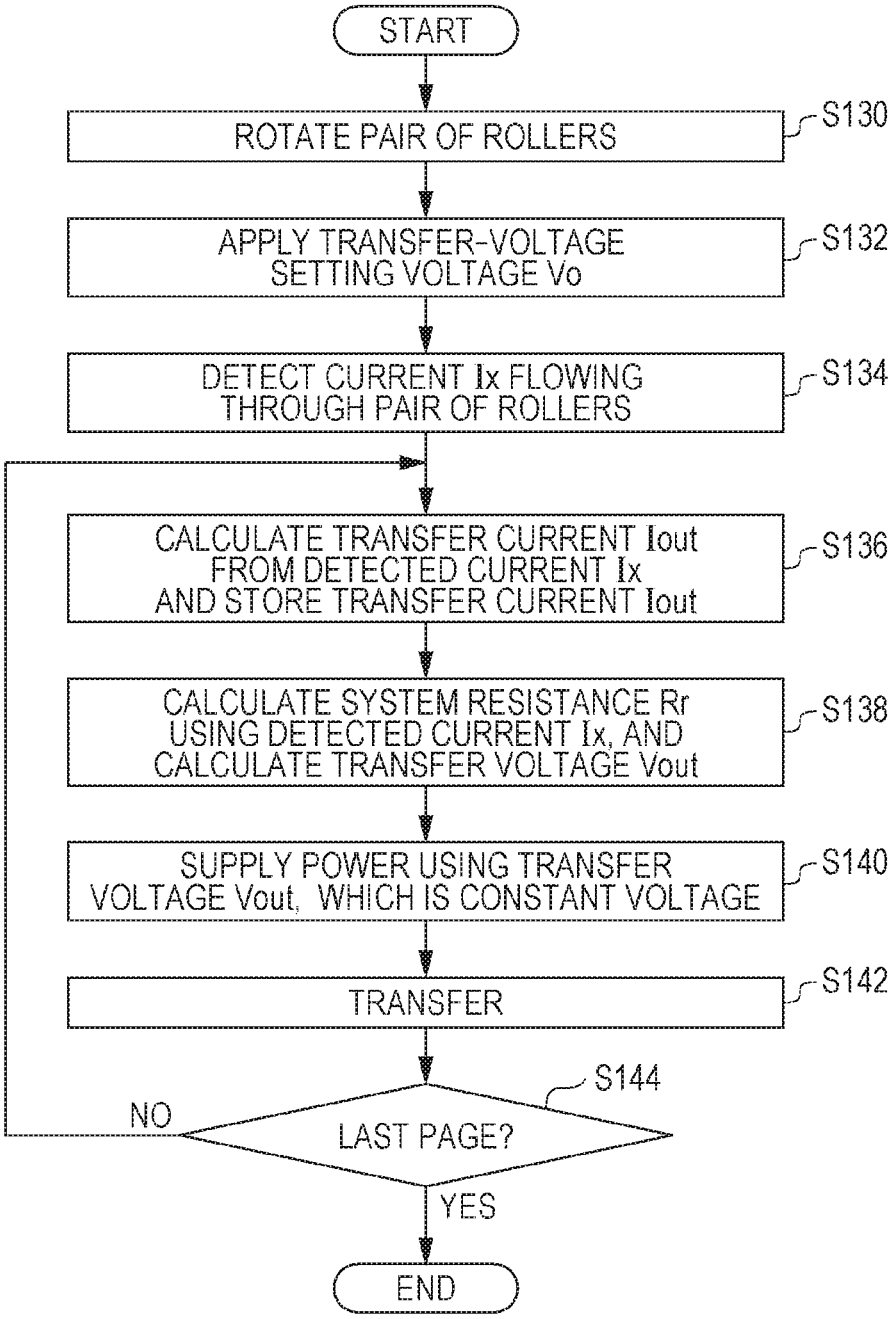
FIG. 9 is a flowchart illustrating an example of a constant voltage control process.

FIG. 9 illustrates an example of a flowchart of the constant voltage control process performed in step S106 of the transfer control program 70P.

First, in step S130, driving of the pair of rollers (the backup roller 7A and the secondary transfer roller 7B) is started by the motor, not illustrated. Here, the motor, not illustrated, is driven in accordance with the process speed included in the transfer start command.

In step S132, the secondary transfer power source 7G is controlled so as to apply the transfer-voltage setting voltage Vo to the pair of rollers. Specifically, the CPU 70A commands the switching unit 76 to cause the constant voltage output unit 72 to output the transfer-voltage setting voltage Vo as a constant voltage. Note that for the transfer-voltage setting voltage Vo, information indicating a predetermined voltage value stored in the nonvolatile memory 82 is used.

Next, in step S134, the detector 7H is controlled such that a detection current Ix flowing through the pair of rollers is detected using the transfer-voltage setting voltage Vo applied from the secondary transfer power source 7G to the pair of rollers in step S132, and also the value of the detected detection current Ix is acquired from the detector 7H and stored in, for example, a predetermined area of the RAM 70C.

In this case, the detector 7H is controlled so as to detect, over a period necessary for the pair of rollers to make one revolution, the detection current Ix flowing through the pair of rollers. Note that, as an example, the detector 7H according to the present exemplary embodiment detects thirty points of the detection current Ix during the period necessary for the pair of rollers to make one revolution.

In step S136, in the case where a toner image is transferred onto a paper sheet P that is the first page, a transfer voltage to be applied from the secondary transfer power source 7G to the pair of rollers is calculated on the basis of the transfer-voltage setting voltage Vo applied to the pair of rollers in step S132 and the detection current Ix detected in step S134, and the secondary transfer power source 7G is set.

Specifically, first, an average detection current Im of the detection current Ix is calculated from the thirty points of the detection current Ix acquired in step S134, and a system resistance value Rr is obtained using Expression (2) using the transfer-voltage setting voltage Vo and the average detection current Im.

$$Rr=Vo/Im \quad (2)$$

Here, Vo represents the transfer-voltage setting voltage. In the present exemplary embodiment, the average of the thirty points of the detection current Ix acquired in step S134 is used as the average detection current Im; however, a value representing multiple detection current values such as a median value or a mode may also be used.

Next, a transfer voltage is calculated by substituting the system resistance value Rr into Expression (3).

$$V\text{out}=\alpha Rr+\beta \quad (3)$$

Note that Vout represents the transfer voltage. In addition, $\alpha$ and $\beta$ are constants each of which is uniquely determined from a combination of pieces of extra information regarding transfer such as a process speed, a paper sheet type, size information, paper-sheet surface information, and environment information, are values obtained in advance through an experiment performed actually using the secondary transfer apparatus 7 or a computer simulation based on the design specification of the secondary transfer apparatus 7, and are for example values determined in accordance with a table prestored in a predetermined area of the nonvolatile memory 82.

Note that, in addition to the above-described method, $\alpha$ and $\beta$ may also be calculated by for example substituting, into a predetermined function prestored in a predetermined area of the nonvolatile memory 82, a number into which extra information regarding transfer such as a process speed, a paper sheet type, size information, paper-sheet surface information, and environment information is converted.

When the transfer voltage Vout is determined as described above, power supply using the transfer voltage Vout, which is a constant voltage, is performed in step S140. That is, in step S140, the secondary transfer power source 7G is controlled so as to apply the transfer voltage Vout to the pair of rollers. Specifically, the CPU 70A commands the switching unit 76 to cause the constant voltage output unit 72 to output the transfer voltage Vout as a constant voltage. Next, in step 142, transfer control is performed in which the transfer voltage Vout is maintained and a toner image is transferred onto the paper sheet P that is the first page, and the process proceeds to step S144.

In step S144, it is determined whether the transfer process is completed by determining whether a page count that is the number of pages for which toner images are transferred onto paper sheets P has reached a transfer page count. In the case where YES is obtained in step S144, the present process routine ends. In the case where NO is obtained in step S144, the process returns to step S136, and processing is repeated until transfer for the last page is performed.

In contrast, in the case where the environment state based on the temperature and humidity exceeds the predetermined change range, image deterioration may occur at the time of transfer. Thus, in the present exemplary embodiment, switching is performed from constant voltage control performed using the transfer voltage Vout determined using the system resistance value Rr to constant current control under which a predetermined current, which is a constant voltage, is output. Specifically, in the case where YES is obtained in step S104 illustrated in FIG. 8 (the absolute humidity AH>the certain humidity range), the constant current control process according to step S108 is executed.

Figure 10:
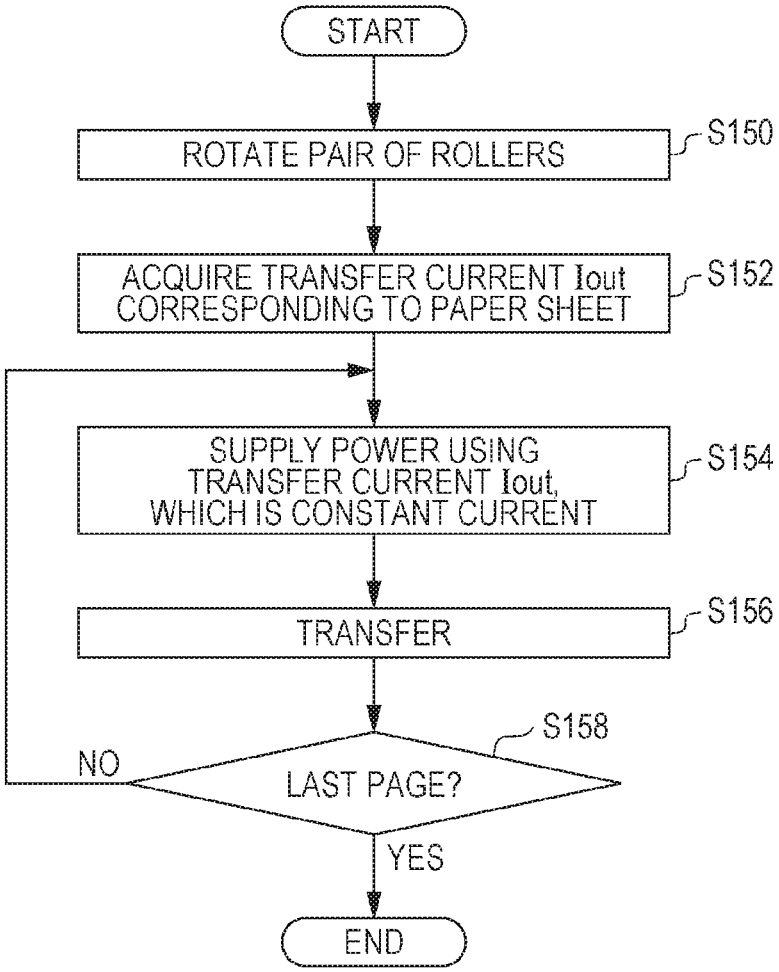
FIG. 10 is a flowchart illustrating an example of a constant current control process.

FIG. 10 illustrates an example of a flowchart of the constant current control process performed in step S108 of the transfer control program 70P.

First, in step S150, driving of the pair of rollers (the backup roller 7A and the secondary transfer roller 7B) is started by the motor, not illustrated, in accordance with the process speed included in the transfer start command.

In step S152, a transfer current Tout corresponding to the paper sheet P is acquired. This transfer current Tout is calculated using the table 82T stored in the nonvolatile memory 82 (FIG. 7). Specifically, the CPU 70A determines, with reference to the table 82T, characteristic information (for example, FIG. 6) indicating a relationship between the process speed and a current value, the process speed corresponding to the attribute information (size, type) and being acquired in step S100. Next, using characteristics indicated by the determined characteristic information (for example, FIG. 7), the CPU 70A calculates a current value corresponding to the process speed acquired in step S100, and stores, for example in a predetermined area of the RAM 70C, the calculated current value as the transfer current Iout. For example, using characteristics CI indicated in FIG. 6, the current value Iout corresponding to a process speed Vp is calculated.

Next, in step S154, the secondary transfer power source 7G is controlled such that the transfer current Iout flows through the pair of rollers. Specifically, the CPU 70A commands the switching unit 76 to cause the constant current output unit 74 to output the transfer current Iout as a constant current.

Next, in step S156, transfer control is performed by controlling the constant current output unit 74 such that the transfer current Iout applied from the secondary transfer power source 7G to the pair of rollers in step S154 is maintained.

In step S158, it is determined whether the transfer process is completed by determining whether the page count that is the number of pages for which toner images are transferred onto paper sheets P has reached the transfer page count. In the case where YES is obtained in step S158, the present process routine ends. In the case where NO is obtained in step S158, the process returns to step S154, and processing is repeated until transfer for the last page is performed.

Next, images are formed on paper sheets P using the image forming apparatus 20 according to the present exemplary embodiment under environments that differ from each other for the transfer process performed under constant voltage control and the transfer process performed under constant current control, and the images formed on the paper sheets P are compared with each other in terms of image quality.

Figure 11A:
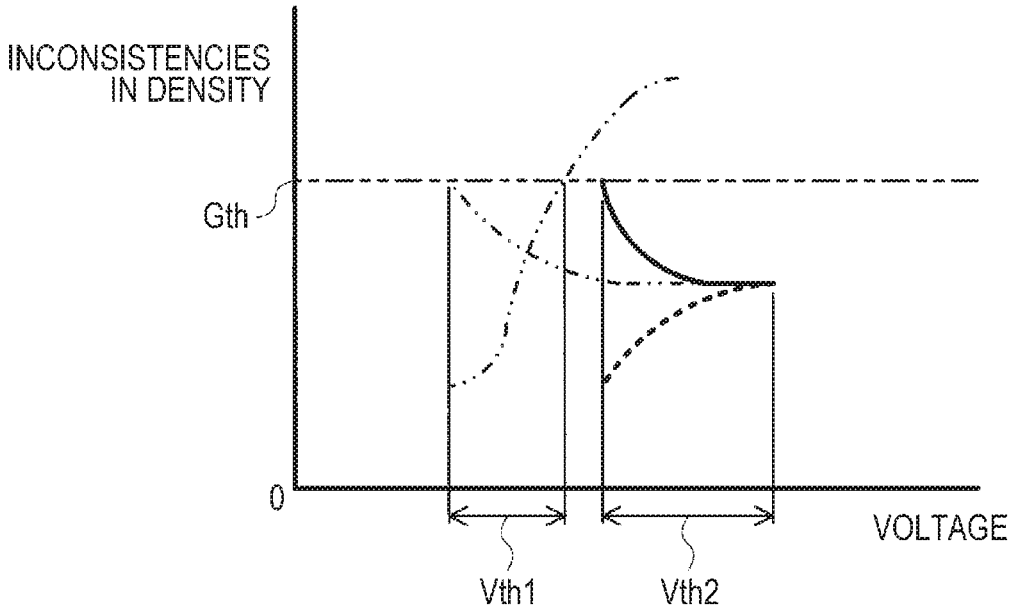
FIGS. 11A and 11B are characteristic diagrams illustrating inconsistencies in density occurring in an image formed on the basis of a voltage and a current applied to a pair of rollers.
Figure 11B:
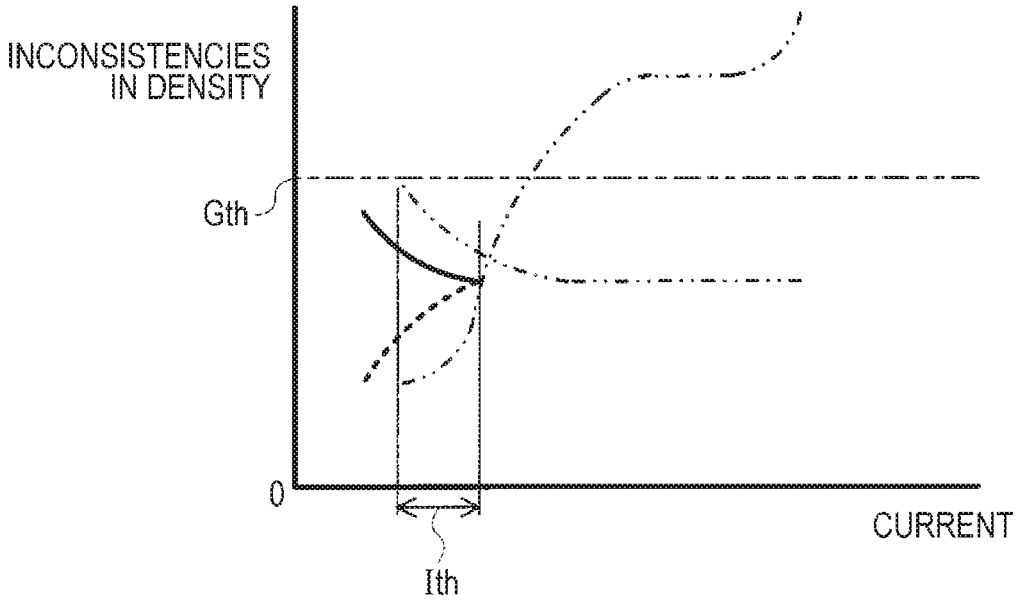

FIGS. 11A and 11B illustrate, as image-quality comparison results of the images formed on the paper sheets P, a relationship between power (voltage or current) applied to the pair of rollers and inconsistencies in density. Note that, here, non-coated paper having a basis weight of 64 gsm is used as paper sheets P. Paper sheets P having a water content of 5.0% are treated as temperature-controlled paper sheets, and paper sheets P having a water content of 10.8% are treated as hydrated paper sheets. Results obtained when a B-color (blue) image and a K-color (black) image are each formed on both a temperature-controlled paper sheet and a hydrated paper sheet are illustrated. FIG. 11A illustrates, using characteristic curves, a relationship between transfer voltage and inconsistencies in density when an image is formed by performing the transfer process under constant voltage control. FIG. 11B illustrates, using characteristic curves, a relationship between transfer current and inconsistencies in density when an image is formed by performing the transfer process under constant current control. Regarding the characteristic curves, the characteristic curve obtained in the case where a B-color (blue) image is formed on a temperature-controlled paper sheet is indicated by a solid line, and the characteristic curve obtained in the case where a K-color (black) image is formed on a temperature-controlled paper sheet is indicated by a dotted line. In addition, the characteristic curve obtained in the case where the B-color (blue) image is formed on a hydrated paper sheet is indicated by a dash-dot line, and the characteristic curve obtained in the case where the K-color (black) image is formed on a hydrated paper sheet is indicated by a dash-dot-dot line. In addition, regarding the inconsistencies in density allowable in images formed on paper sheets P, an upper limit obtained through various experiments is indicated as inconsistencies in density Gth in FIGS. 11A and 11B.

As illustrated in FIG. 11A, when the B-color image and the K-color image are formed on temperature-controlled paper sheets by applying a transfer voltage under constant voltage control, the inconsistencies in density are reduced in a transfer-voltage voltage range Vth2 (less than or equal to the inconsistencies in density Gth). In addition, when the B-color image and the K-color image are formed on hydrated paper sheets, the inconsistencies in density are reduced in a transfer-voltage voltage range Vth1. In order to form images on both temperature-controlled and hydrated paper sheets while reducing the inconsistencies in density, constant voltage control needs to be performed using transfer voltages that differ from each other.

In contrast, as illustrated in FIG. 11B, when the B-color image and the K-color image are formed by applying a transfer current under constant current control, the inconsistencies in density are reduced in a transfer-current current range Ith (less than or equal to the inconsistencies in density Gth) for both the temperature-controlled paper sheets and the hydrated paper sheets.

In addition, FIGS. 12A and 12B illustrate image-quality evaluation results of the images formed on the paper sheets P. Note that the image quality of each of the images formed on the paper sheets P is determined on the basis of the presence or absence and degree of inconsistencies in the density of the formed image. FIG. 12A illustrates, for transfer voltages used when an image is formed by performing the transfer process under constant voltage control, evaluation results of inconsistencies in the density of B color and K color on both temperature-controlled and hydrated paper sheets. FIG. 12B illustrates, for transfer currents used when an image is formed by performing the transfer process under constant current control, evaluation results of inconsistencies in the density of B color and K color on both temperature-controlled and hydrated paper sheets. In FIGS. 12A and 12B, the case where the inconsistencies in the density of an image formed on a paper sheet P are sufficiently reduced is indicated by a double circle mark, the case where the inconsistencies in the density of the image are reduced is indicated by a circle mark, the case where the inconsistencies in the density of the image occur is indicated by a triangle mark, and the case where the inconsistencies in the density of the image occur significantly is indicated by an X mark.

As is understood from the evaluation results illustrated in FIGS. 12A and 12B, in order to form images on both temperature-controlled and hydrated paper sheets while reducing the inconsistencies in density under constant voltage control, constant voltage control needs to be performed using transfer voltages that differ from each other.

As described above, according to the present exemplary embodiment, the system resistance value Rr is calculated by applying the transfer-voltage setting voltage Vo, which is a predetermined voltage, to the pair of rollers in a non-transfer period in the case where a toner image formed on the intermediate transfer belt 6 is to be transferred onto a paper sheet P. A transfer voltage is determined using the system resistance value Rr, and transfer control is performed under constant voltage control. In the case where an environment state based on humidity exceeds an allowable range (a threshold) as the image forming operation environment of the image forming apparatus 20, transfer control is performed under constant current control such that a transfer current is applied.

(Second Exemplary Embodiment)

Next, a second exemplary embodiment will be described. Note that the configuration of the second exemplary embodiment is substantially the same as that of the first exemplary embodiment, and thus portions the same as those in the first exemplary embodiment are denoted by the same reference numerals and description thereof will be omitted.

In the first exemplary embodiment, the transfer current Iout corresponding to the paper sheet P and calculated using the table 82T (FIG. 7) stored in the nonvolatile memory 82 is acquired, and the transfer process is performed under constant current control using the acquired transfer current Iout. In the second exemplary embodiment, the transfer current Iout is calculated from a current value obtained at the time of constant voltage control for calculating a system resistance value, and in the case where an environment state based on humidity exceeds an allowable range (a threshold), constant current control is performed using the calculated transfer current Iout.

Next, an operation of a computer serving as the transfer controller 70 according to the second exemplary embodiment will be described.

In the present exemplary embodiment, at the time of constant voltage control, that is, in step S136 illustrated in FIG. 9, a transfer current Iout is also calculated in addition to calculation of a transfer voltage Vout to be applied to the pair of rollers. Note that the transfer current Iout may be calculated from the above-described Expression (2) using a transfer voltage Vout calculated using the above-described Expression (3) and a system resistance value Rr.

In addition, as characteristic information, information in which information indicating the calculated transfer current Iout is associated with information indicating the process speed acquired in step S100 illustrated in FIG. 8 is stored, as a table, in the nonvolatile memory 82 on an attribute-information basis. That is, in the present exemplary embodiment, information corresponding to the table 82T illustrated in FIG. 7 is stored in the nonvolatile memory 82 in step S136 illustrated in FIG. 9.

Note that, here, the information in which the information indicating the transfer current Iout is associated with the information indicating the process speed is treated as the characteristic information; however, the characteristic information is not limited to this. Characteristics indicating a relationship between the transfer current Iout and a process speed may be obtained from a relationship between information indicating multiple process speeds and information indicating corresponding transfer currents Iout, and may be treated as characteristic information.

Next, in the present exemplary embodiment, at the time of constant current control, the transfer current Iout corresponding to the paper sheet P is acquired in step S152 illustrated in FIG. 10. That is, the transfer current Iout is calculated using the table calculated as above and stored in the nonvolatile memory 82 in the present exemplary embodiment. Next, in step S154, the secondary transfer power source 7G is controlled such that the transfer current Iout flows through the pair of rollers. In step S156, transfer control is performed by controlling the constant current output unit 74 such that the transfer current Iout is maintained.

In this manner, according to the present exemplary embodiment, a transfer current obtained at the time of constant voltage control is stored, and the transfer process is performed under constant current control using the stored transfer current in the case where an environment state based on humidity exceeds an allowable range (a threshold).

The present invention has been described above using the exemplary embodiments; however, the technical scope of the present invention is not limited to the scope described in the exemplary embodiments above. Various modifications or improvement may be added to the exemplary embodiments described above without departing from the gist of the invention, and exemplary embodiments obtained by adding the variations or modifications to the exemplary embodiment described above also fall within the technical scope of the invention.

In addition, the case where the transfer control process is realized with a software configuration based on processing using the flowchart illustrated in FIG. 8 is described in the exemplary embodiments described above; however, the way in which the transfer control process is realized is not limited to this. For example, the transfer control process may also be realized with a hardware configuration.

As an example of an exemplary embodiment in this case, for example, there may be a case where a functional device that executes the same process as the transfer controller 70 of the secondary transfer apparatus 7 is generated and used. In this case, the process speed is expected to increase more than those in the exemplary embodiments described above.

Note that the image forming apparatus 20 according to the present exemplary embodiment forms color images; however, as a matter of course the image forming apparatus 20 may also form monochrome images. In addition, the secondary transfer roller 7B of the secondary transfer apparatus 7 according to the present exemplary embodiment is not limited to the form including a single roller. For example, multiple rollers and belts including the secondary transfer roller 7B, another roller that is not illustrated, and a belt extending around the secondary transfer roller 7B and the other roller that is not illustrated may also be included in the secondary transfer apparatus 7.

In addition, the secondary transfer apparatus 7 according to the present exemplary embodiment applies a negative transfer voltage from the secondary transfer power source 7G to the pair of rollers. This is performed to strip off a negatively charged toner image from the intermediate transfer belt 6, and thus when a toner image is positively charged, a positive transfer voltage is applied to the pair of rollers.

In addition, the transfer control process according to the present exemplary embodiment is described using as an example the secondary transfer apparatus 7 of the image forming apparatus 20; however, the transfer control process according to the present exemplary embodiment may also be applied to the first transfer device 5.

Furthermore, the transfer control process according to the present exemplary embodiment may be performed not only by the secondary transfer apparatus 7 of the image forming apparatus 20 but also by, for example, a transfer apparatus that transfers a charged toner image onto an object onto which transfer is to be performed, the object being, for example, paper, a plastic sheet, typified by an overhead projector (OHP) sheet, metal, or rubber.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer apparatus comprising:

a transfer unit configured to transfer a toner image onto an object;

a detector configured to detect humidity;

a supplying unit that includes:

a constant voltage supplying unit configured to supply a transfer voltage that is a constant voltage to the transfer unit; and a constant current supplying unit configured to supply a transfer current that is a constant current to the transfer unit;

a controller configured to control the supplying unit such that the transfer voltage is supplied from the constant voltage supplying unit to the transfer unit when transfer is performed in a case where humidity detected by the detector is less than or equal to a threshold, and the transfer current is supplied from the constant current supplying unit to the transfer unit when transfer is performed in a case where humidity detected by the detector exceeds the threshold; and a current detector configured to detect a current flowing through the transfer unit, wherein the controller is configured to control the supplying unit such that, in a non-transfer period before the toner image is transferred onto the object and i the case where the humidity detected by the detector is less than or equal to the threshold, a transfer voltage derived using a setting voltage and a current detected by the current detector in accordance with supply of the setting voltage is supplied from the constant voltage supplying unit to the transfer unit when the transfer is performed.

2. The transfer apparatus according to claim 1, wherein the controller is configured to control the supplying unit such that, when transfer is performed in a case where information indicating the current detected by the current detector in accordance with supply of the setting voltage is stored in a memory and the humidity detected by the detector exceeds the threshold, a transfer current derived using information indicating the stored current is supplied from the constant current supplying unit to the transfer unit.

3. The transfer apparatus according to claim 2, further comprising:

an acquisition unit configured to acquire, from a memory storing information indicating current values corresponding to a plurality of respective types of objects onto which transfer is to be performed, information indicating a current value corresponding to a type of object onto which the toner image is to be transferred, wherein the controller is configured to control the supplying unit such that, when transfer is performed in the case where the humidity detected by the detector exceeds the threshold, a current based on the current value acquired by the acquisition unit is supplied from the constant current supplying unit to the transfer unit.

4. A non-transitory computer readable medium storing a program causing a computer to execute a process, the process comprising:

performing control such that a transfer voltage that is a constant voltage is supplied when transfer is performed in a case where detected humidity is less than or equal to a threshold, and a transfer current that is a constant current is supplied when transfer is performed in a case where detected humidity exceeds the threshold;

detecting a current flowing through a transfer unit configured to transfer a toner image onto an object; and controlling such that, in a non-transfer period before the toner image is transferred onto the object and in the case where detected humidity is less than or equal to the threshold, a transfer voltage derived using a setting voltage and the detected current, which is detected in accordance with supply of the setting voltage, is supplied to the transfer unit when the transfer is performed.

5. An image forming apparatus comprising:

an image carrier;

a charging unit configured to charge the image carrier;

a forming unit configured to form an electrostatic latent image by exposing the image carrier charged by the charging unit to light;

a developing unit configured to develop, using toner, the electrostatic latent image formed on the image carrier by the forming unit; and the transfer apparatus according to claim 1.

* * * * *